US011284682B2

(12) United States Patent
Purnomohadi

(10) Patent No.: US 11,284,682 B2
(45) Date of Patent: Mar. 29, 2022

(54) TOOL HAVING INTERCONNECTED LINKS THAT FORM AT LEAST A PORTION OF A WEARABLE ACCESSORY

(71) Applicant: LEATHERMAN TOOL GROUP, INC., Portland, OR (US)

(72) Inventor: Andro Purnomohadi, Vancouver, WA (US)

(73) Assignee: LEATHERMAN TOOL GROUP, INC., Portland, OR (US)

( * ) Notice: Subject to any disclaimer, the term of this patent is extended or adjusted under 35 U.S.C. 154(b) by 101 days.

(21) Appl. No.: 16/674,654

(22) Filed: Nov. 5, 2019

(65) Prior Publication Data

US 2021/0127799 A1 May 6, 2021

(51) Int. Cl.
*A44C 5/10* (2006.01)
*A44C 5/00* (2006.01)

(52) U.S. Cl.
CPC ..... *A44C 5/0007* (2013.01); *A44C 5/107* (2013.01)

(58) Field of Classification Search
CPC ..... A44C 5/10; A44C 5/107; A44C 5/0007; A44C 5/02; A44C 5/102; A44C 5/105; F16G 15/12
USPC ..... D10/30–39; 59/84, 85, 87, 88
See application file for complete search history.

(56) References Cited

U.S. PATENT DOCUMENTS

| | | | | | |
|---|---|---|---|---|---|
| 4,928,504 | A * | 5/1990 | Tuppini | A44C 5/107 | 59/82 |
| 6,026,637 | A * | 2/2000 | Dombre | A44C 5/107 | 59/80 |
| 2002/0050133 | A1* | 5/2002 | Cazard | A44C 5/107 | 59/80 |
| 2015/0189956 | A1* | 7/2015 | Rivera | B25G 1/08 | 224/152 |
| 2019/0000194 | A1* | 1/2019 | Lazenby | A44C 5/0007 | |

FOREIGN PATENT DOCUMENTS

| | | | | |
|---|---|---|---|---|
| CH | 666798 | A5 * | 8/1988 | A44C 5/107 |
| CH | 711554 | A2 * | 9/2015 | A44C 5/10 |
| DE | 9411374 | U1 * | 10/1994 | A44C 5/107 |
| GB | 2160614 | A * | 12/1985 | F16G 13/06 |

* cited by examiner

*Primary Examiner* — Emily M Morgan
(74) *Attorney, Agent, or Firm* — Alston & Bird LLP

(57) ABSTRACT

A tool is provided that includes a plurality of links including at least three links movably interconnected to one another to form at least a portion of a wearable accessory, such as a bracelet. The plurality of links are articulatable so as to alternately assume a first configuration in which the plurality of links extend linearly, a second configuration in which the plurality of links are curved about an axis in a first direction and a third configuration in which the plurality of links are curved about the axis in a second direction, opposite the first direction. The plurality of links are configured to permit limited motion in a direction parallel to the axis prior to becoming structurally rigid. At least one link includes at least one tool function. A clasp and a receiver are also provided to facilitate the functionality and versatility of the resulting wearable accessory.

18 Claims, 14 Drawing Sheets

TOOL HAVING INTERCONNECTED LINKS THAT FORM AT LEAST A PORTION OF A WEARABLE ACCESSORY

TECHNOLOGICAL FILED

An example embodiment of the present invention relates generally to a tool for providing a plurality of tool functions and, more particularly, to a tool having a plurality of links that are interconnected to form at least a portion of a wearable accessory with at least one of the links including one or more tool functions.

BACKGROUND

People commonly utilize a variety of tools to perform various functions. For example, tools may be used for assembly or repair, such as to repair a bicycle, to assemble a newly purchased item or the like. Tools are also routinely used for even more pedestrian tasks, such as changing batteries, opening a drink, cutting open a package or the like. As such, many people desire ready access to the most commonly utilized tools, such as screwdrivers, wrenches, knives, bottle openers and the like. While people may utilize a plurality of individual tools for performing the functions described above as well as many other functions, it may be challenging to carry and have access to the plurality of individual tools when and where they may be needed. As such, multipurpose tools shave been developed in order to provide a single tool that includes a plurality of tool members for performing various functions.

While multipurpose tools are advantageous in regards to the wide variety of tool members that are available, people may still be limited in regards to when they may carry a multipurpose tool. For example, people may sometimes be prevented from carrying their multipurpose tool on an aircraft or in another secure environment, such as within a school, a stadium, etc. Even if permitted to carry a multipurpose tool, people may sometime not wish to carry the multipurpose tool due to, for example, the type of clothing being worn, the activity to be undertaken or the like. As such, people may sometimes leave their multipurpose tool behind, such as when they are traveling or entering another secure environment, and therefore not have their multipurpose tool with them when they need it. Thus, the availability of multipurpose tools may also be more limited in some instances than is desired.

BRIEF SUMMARY

A tool is provided in accordance with an example embodiment that includes a plurality of link units interconnected to one another to form at least a portion of a wearable accessory, such as a bracelet. At least one of the link units may include at least one tool function. By being configured as at least a portion of a wearable accessory and by judicious selection of the tool functions to provide the desired functionality without including a prohibited item, such as a knife, the tool of an example embodiment may therefore be suitable to be carried in a wider range of situations, including on board an aircraft or in other secure environments. Thus, the tool of an example embodiment may facilitate the availability of the tool functions provided by the links of the wearable accessory in a potentially broader range of situations. A clasp is also provided according to other embodiments of the present invention in order to facilitate the functionality and versatility of the resulting wearable accessory.

In one embodiment, a tool is provided that includes a plurality of link units including at least three link units movably interconnected to one another to form at least a portion of a wearable accessory, such as a bracelet. The plurality of links are articulatable so as to alternately assume a first configuration in which the plurality of links extend linearly and a second configuration in which the plurality of links are curved about an axis in a first direction. The plurality of links are configured to permit limited motion in a direction parallel to the axis prior to becoming structurally rigid.

The link units may have a curved shape and may be interconnected such that a concave surface of the links faces an interior of the bracelet. In an example embodiment, the tool may further include a clasp operably connected to the plurality of link units. In this embodiment, the clasp is configured to alternately move between an open position and a closed position so as to open and close the wearable accessory, respectively. Additionally or alternatively, the detachable feature may be a ratchet, a fire starter, a phone or other communication device, a mirror, a global positioning system (GPS), a light, a personal location beacon, an exercise computer, e.g., a pedometer, or a storage case.

The tool of an example embodiment may include a plurality of link units movably interconnected to one another to form at least a portion of a wearable accessory, where the link units include a link disposed between two linkage members, where the link is held in a fixed position relative to the two linkage members in response to the two linkage members engaging the link, wherein the link of a link unit includes a tool to provide a tool function, and where a first link unit is connected to a second link unit by a pin engaged through two linkage members of the second link unit, two linkage members of the first link unit, and the first link. The two linkage members of the first link unit may include keys and the link of the first link unit may include corresponding keyways to receive the keys of the two linkage members of the first link unit. The keys received into the keyways may hold the two linkage members and the link of the first link unit in a fixed relationship in response to engagement.

The plurality of link units may be articulatable so as to alternately assume: a first configuration in which the plurality of link units are curved about an axis in order to define an opening through the tool, where the tool may be configured to be worn by a user in the first configuration, and a second configuration in which the plurality of link units may be repositioned to close the opening defined through the tool in the first configuration, and the plurality of links may be configured to serve as a handle to facilitate actuation of a respective tool function in the second configuration. The respective tool function may be positioned so as to be substantially on a centerline defined by the plurality of link units in the first configuration, and the respective tool function may extend outwardly from the plurality of link units in the second configuration. The plurality of link units may be repositioned in the second configuration to extend linearly to serve as the handle with the respective tool function at one end thereof. Each link unit may include a substantially arcuate profile. The plurality of link units may join together such that a concavity of the substantially arcuate profile faces an interior of the tool.

Embodiments may include a watch lug engaging link, where the watch lug engaging link includes two adjustable pins disposed within the watch lug engaging link and are biased away from one another. The watch lug engaging link may include two set screws, each set screw configured to engage a respective adjustable pin and hold the respective adjustable pin in a fixed position. The tool of example embodiments may include a clasp and a band, where the band is connected to a first link unit. The clasp may include a first clasp member having a first tab and a second clasp member having a second tab, where the first clasp member is pivotably attached to a second link unit, and where the second clasp member is pivotably attached to the first clasp member. The band may include a plurality of holes, where the first tab of the first clasp member is configured to engage a first hole of the band, and the second tab of the second clasp member is configured to engage a second hole of the band to close the clasp.

Embodiments of the tool may include a clasp and a band where the band is connected to a first link unit, where the clap includes a first clasp member pivotably attached to a second link unit, and a second clasp member is removably attached to the strap. The first clasp member may be configured to magnetically engage the first clasp member to close the clasp. The first clasp member may include at least one toggle element, where the toggle element is held in a first position when the first clasp member is not engaged with the second clasp member, and where the at least one toggle element is magnetically biased into engagement with the second clasp member in response to the first clasp member engaging the second clasp member.

Embodiments provided herein may include a link unit for a wrist-worn tool. The link unit may include: a link member including a tool member and defining first and second opposing keyways; a first linkage member including a first key; a second linkage member including a second key, where the first key of the first linkage member is configured to engage the first keyway of the link member, where the second key of the second linkage member is configured to engage the second keyway of the link member, and where the link member is held in a fixed position relative to the first linkage member and the second linkage member in response to the first key engaging with the first keyway and the second key engaging with the second keyway. The first linkage member and the second linkage member may extend in a first direction from the link member in response to the first key engaging with the first keyway and the second key engaging with the second keyway, and where the tool member extends in a direction substantially opposite to the first direction.

According to some embodiments, a hole is defined through the first linkage member through the first key, through the second linkage member and the second key, and through the link member, where the hole is configured to receive there through a pin for securing the link unit to another link unit. In response to the first key engaging with the first keyway and the second key engaging with the second keyway, the link unit defines a substantially arcuate profile. The concave side of the link unit is configured to at least partially encircle a wrist of a wearer of the wrist-worn tool.

BRIEF DESCRIPTION OF THE DRAWINGS

Figure 1:
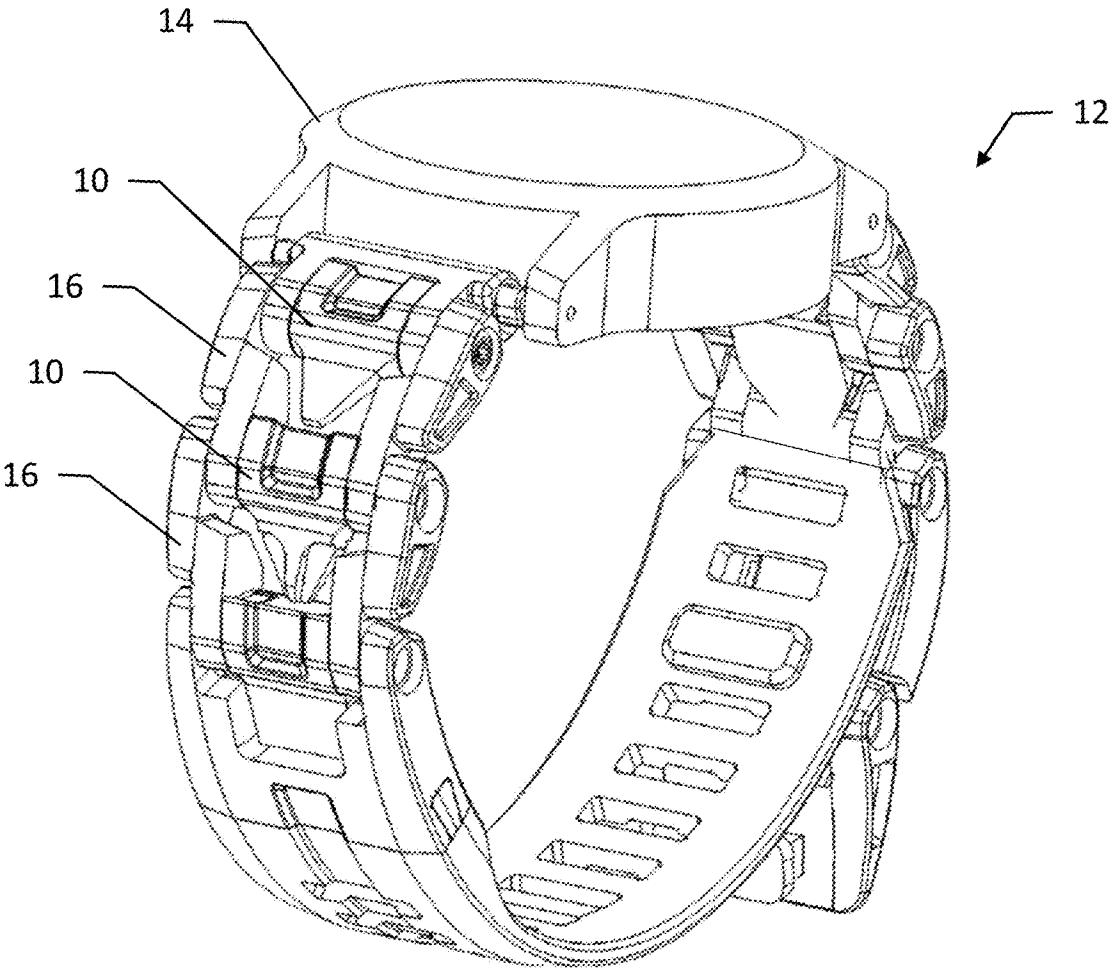
Figure 2:
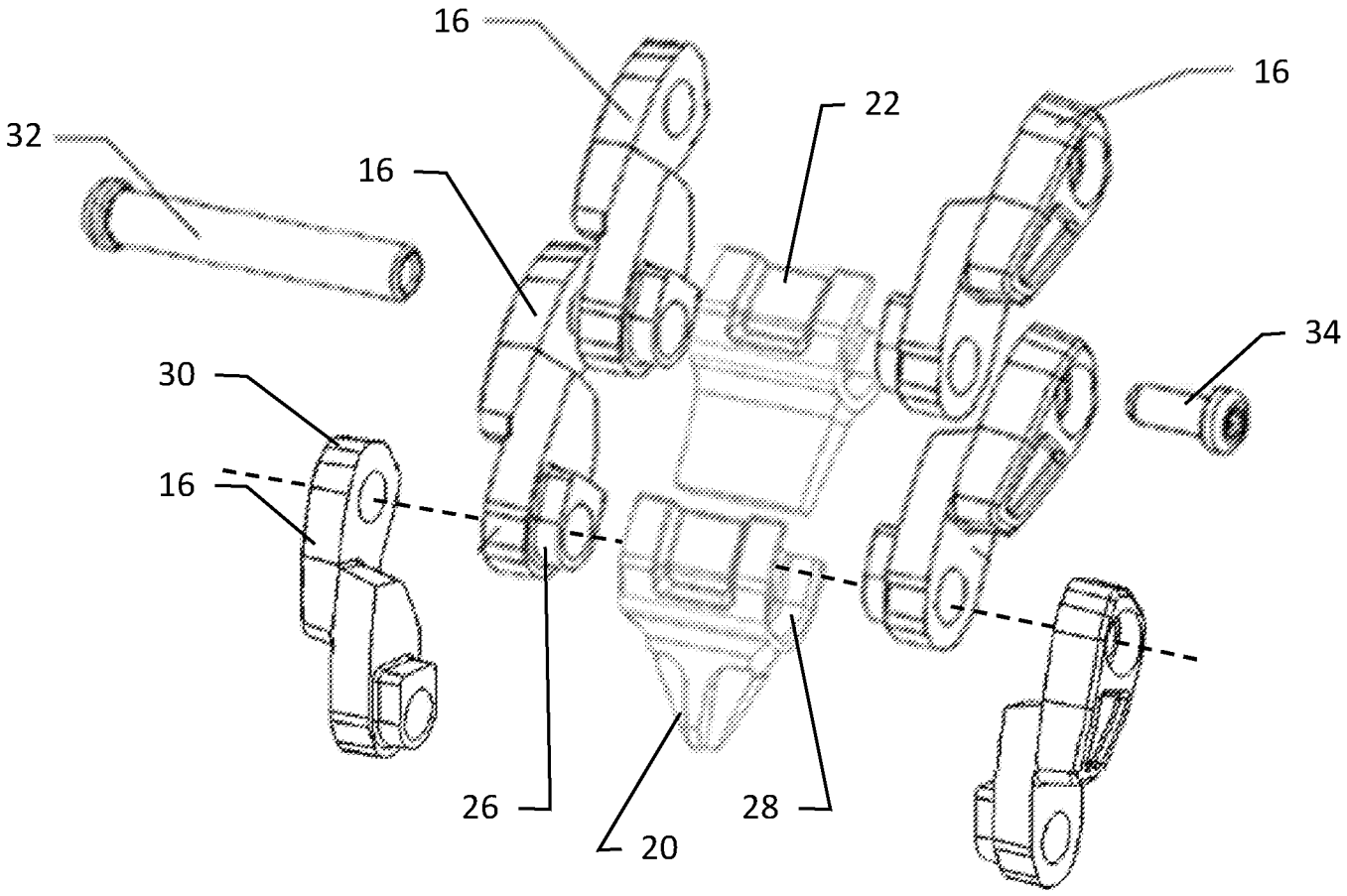
Figure 3:
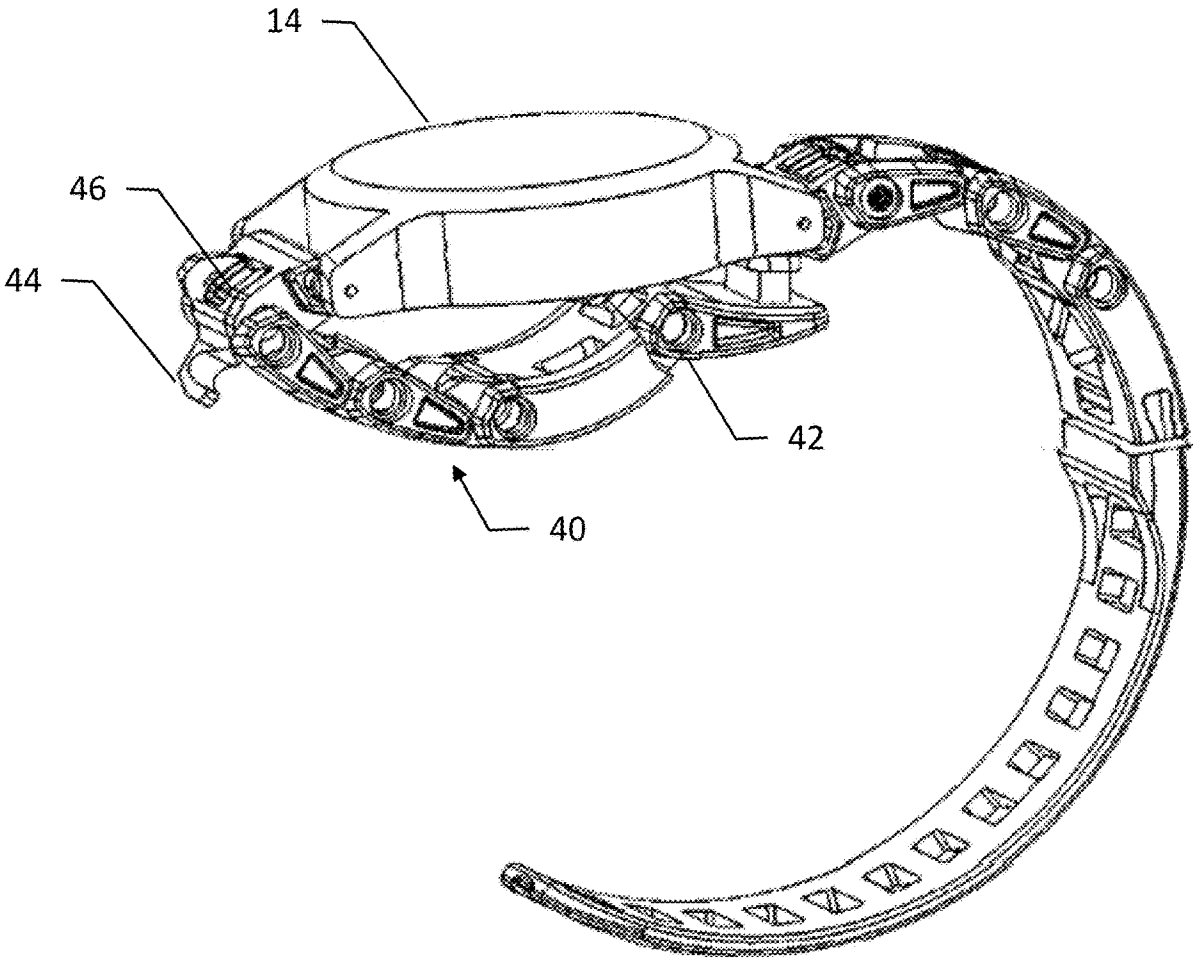
Figure 4:
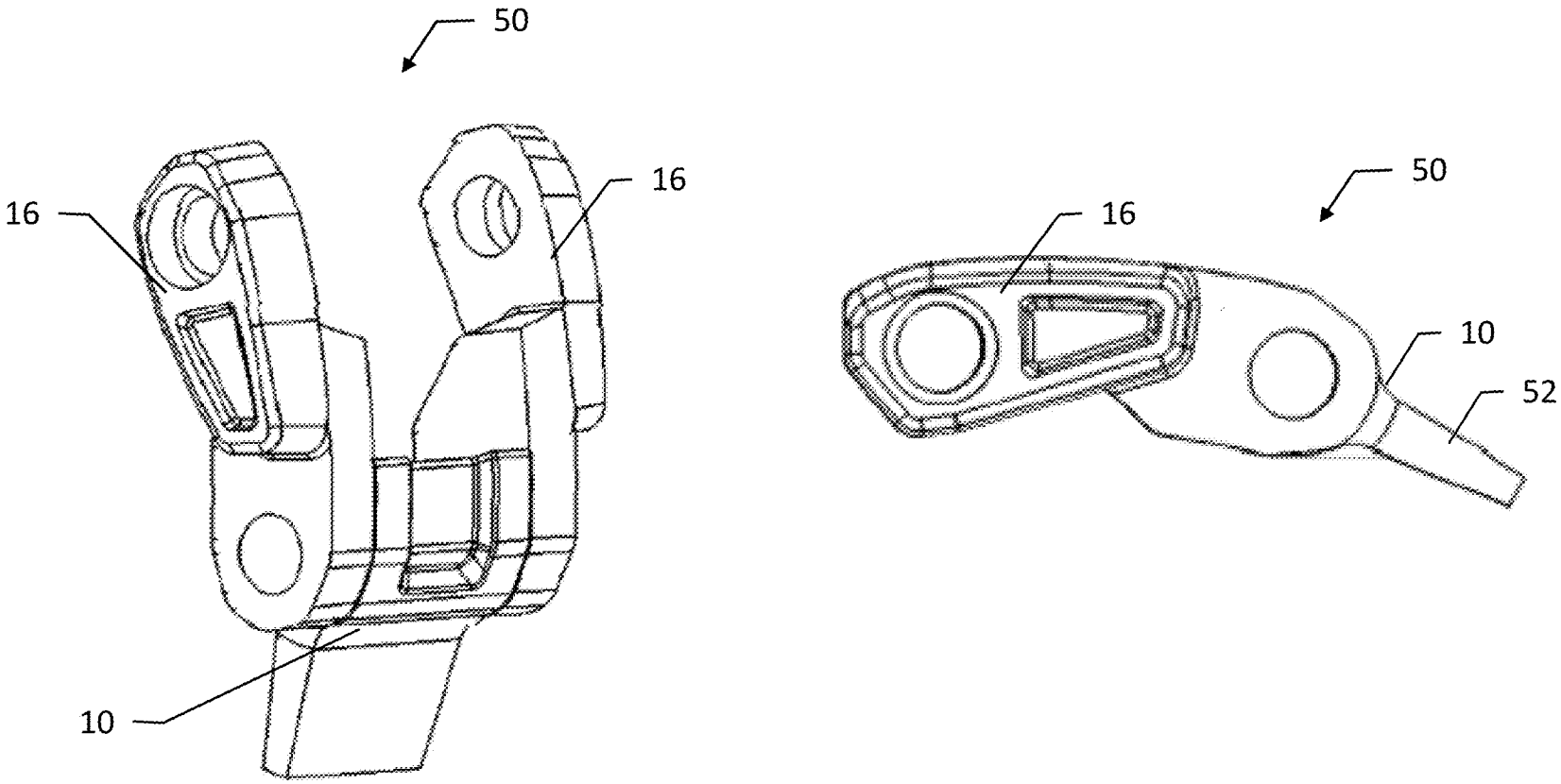
Figure 5:
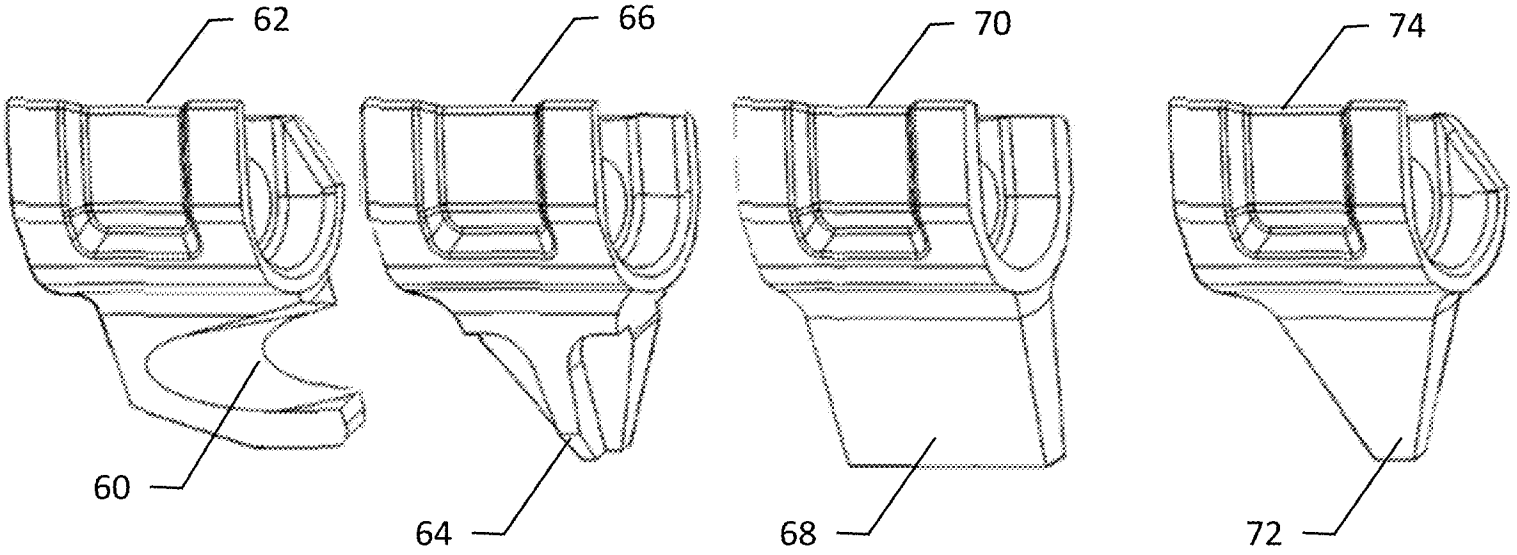
Figure 6:
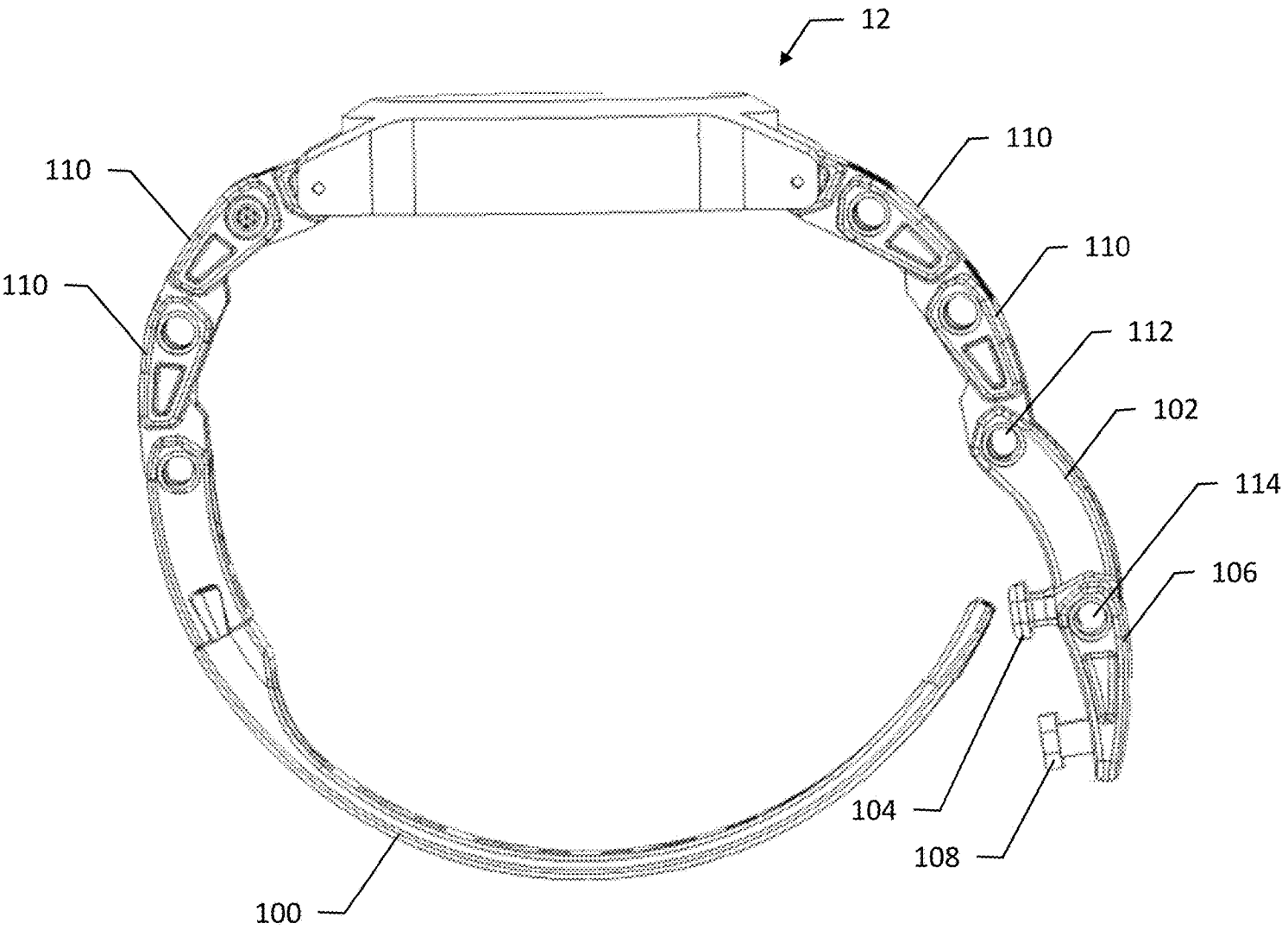
Figure 7:
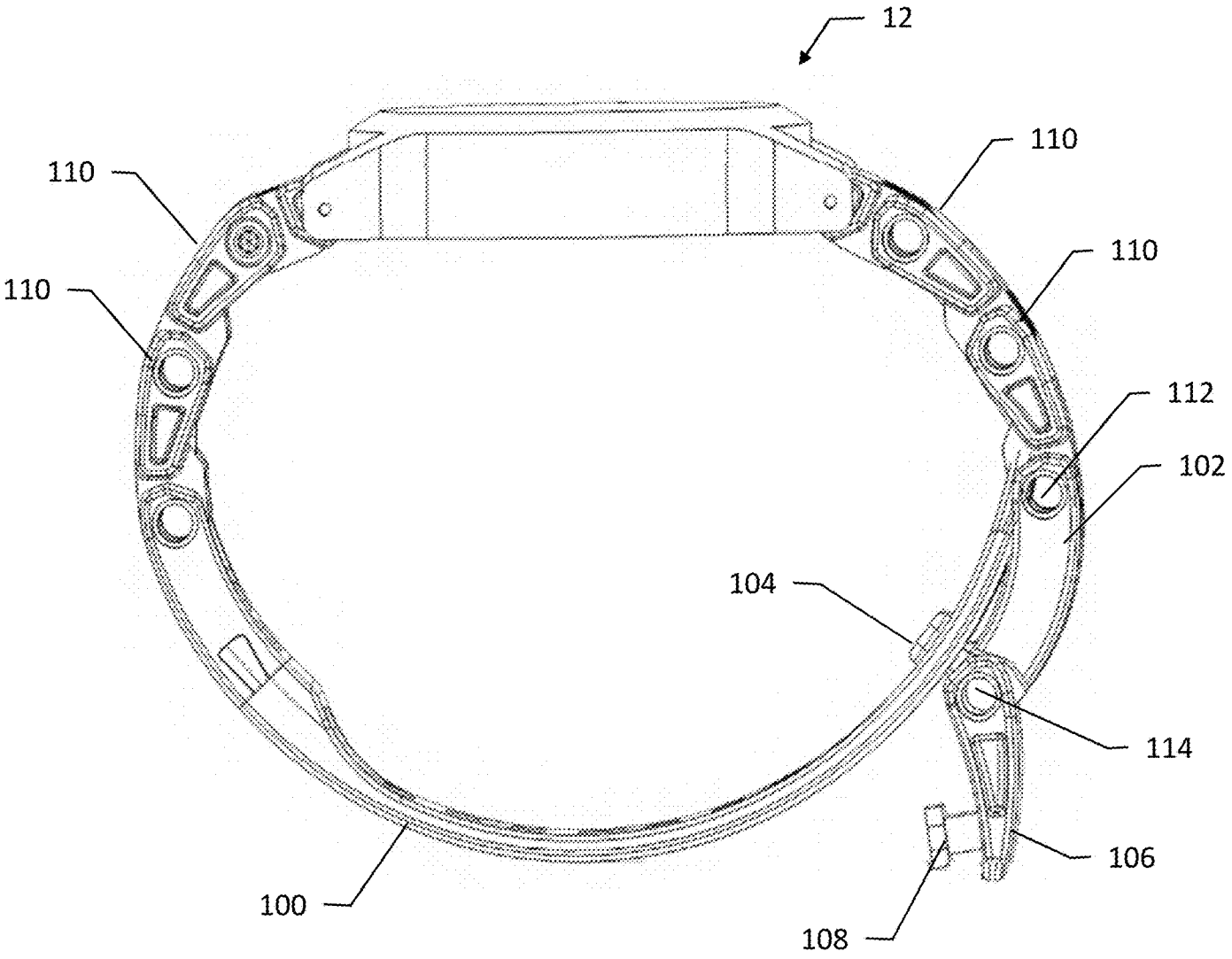
Figure 8:
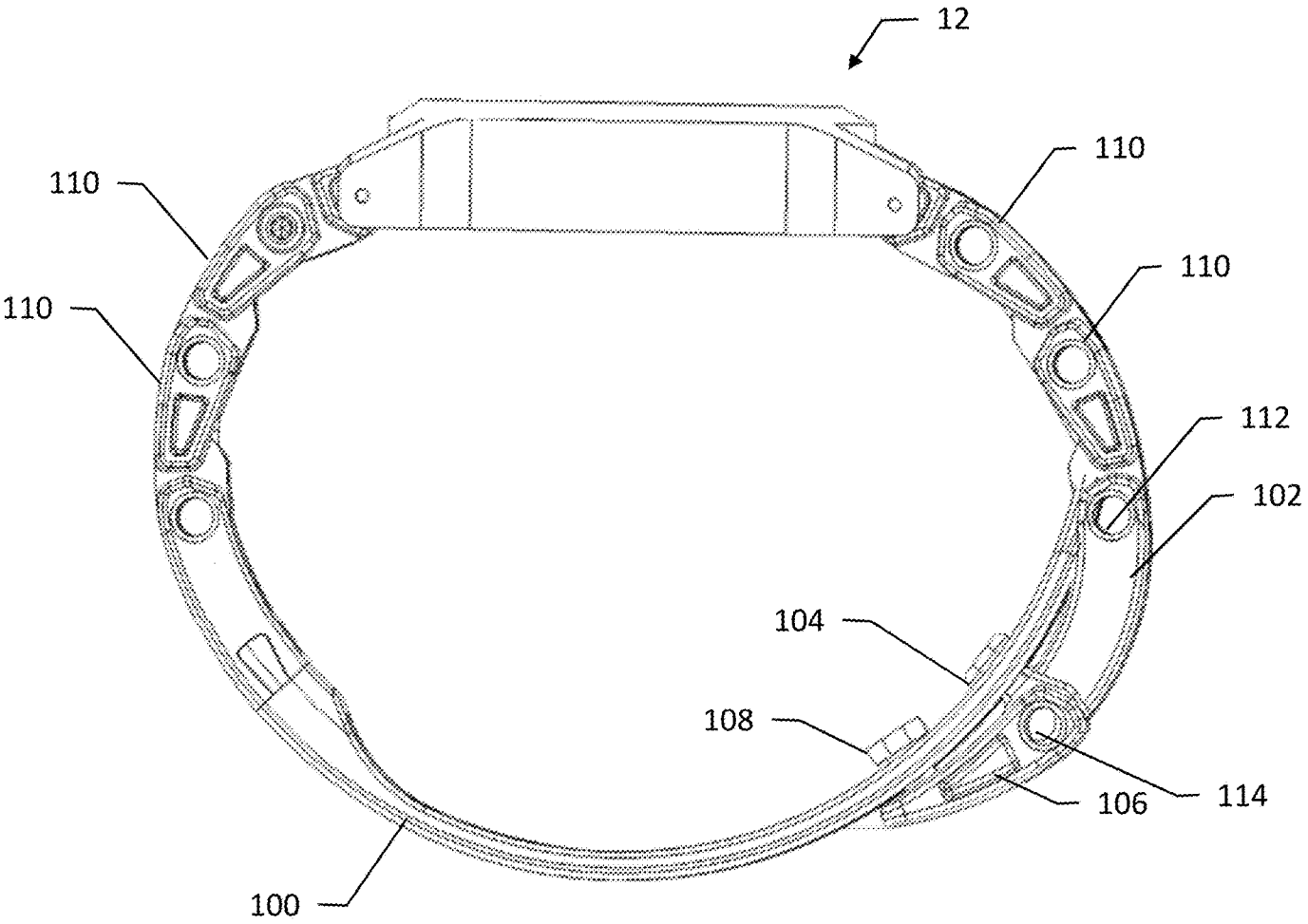
Figure 9:
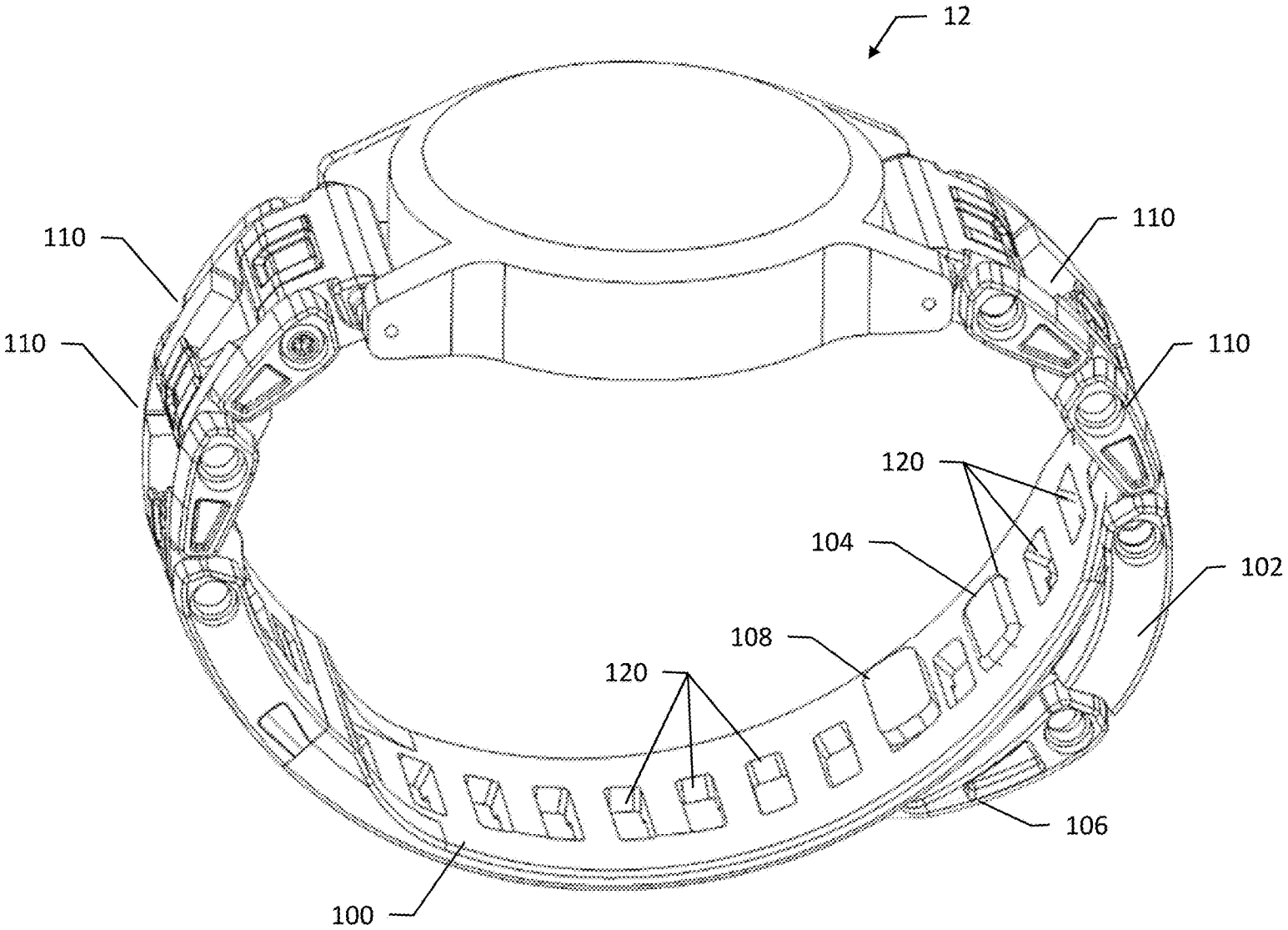
Figure 10:
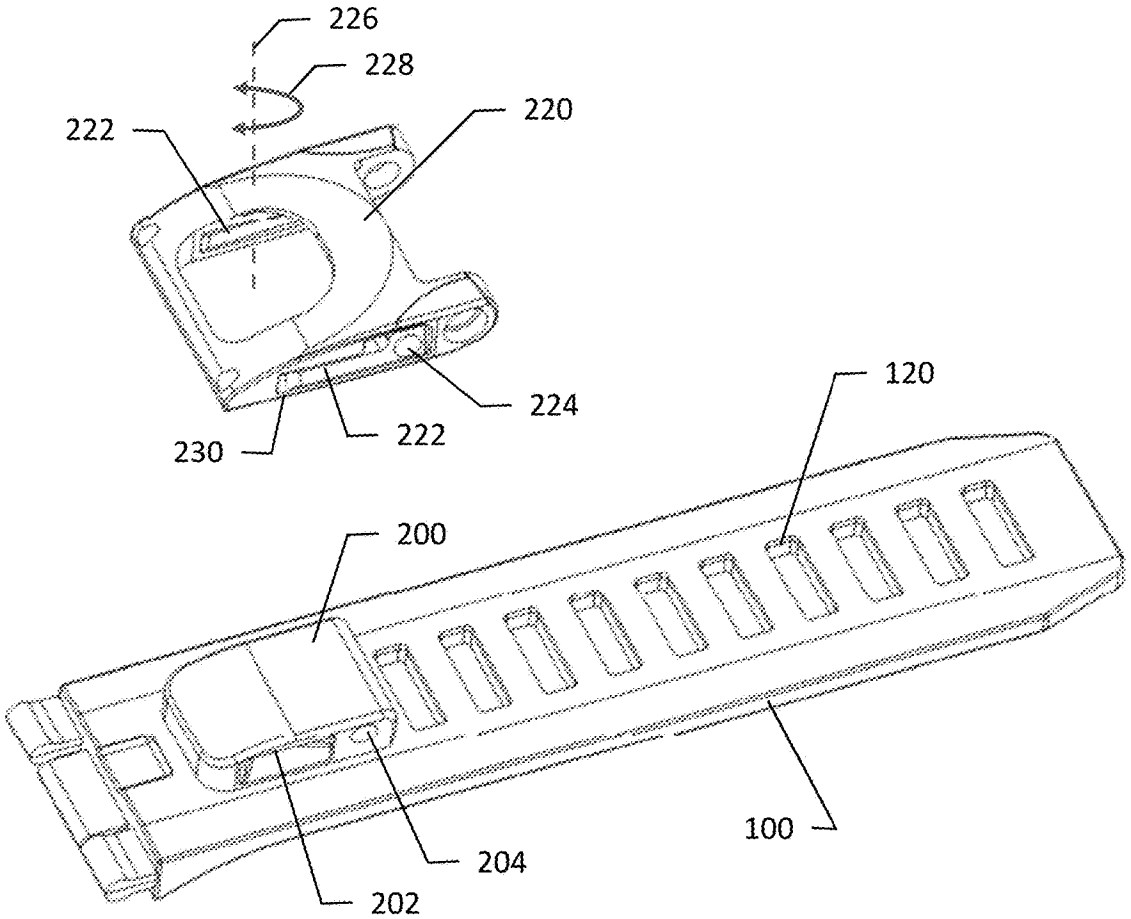
Figure 11:
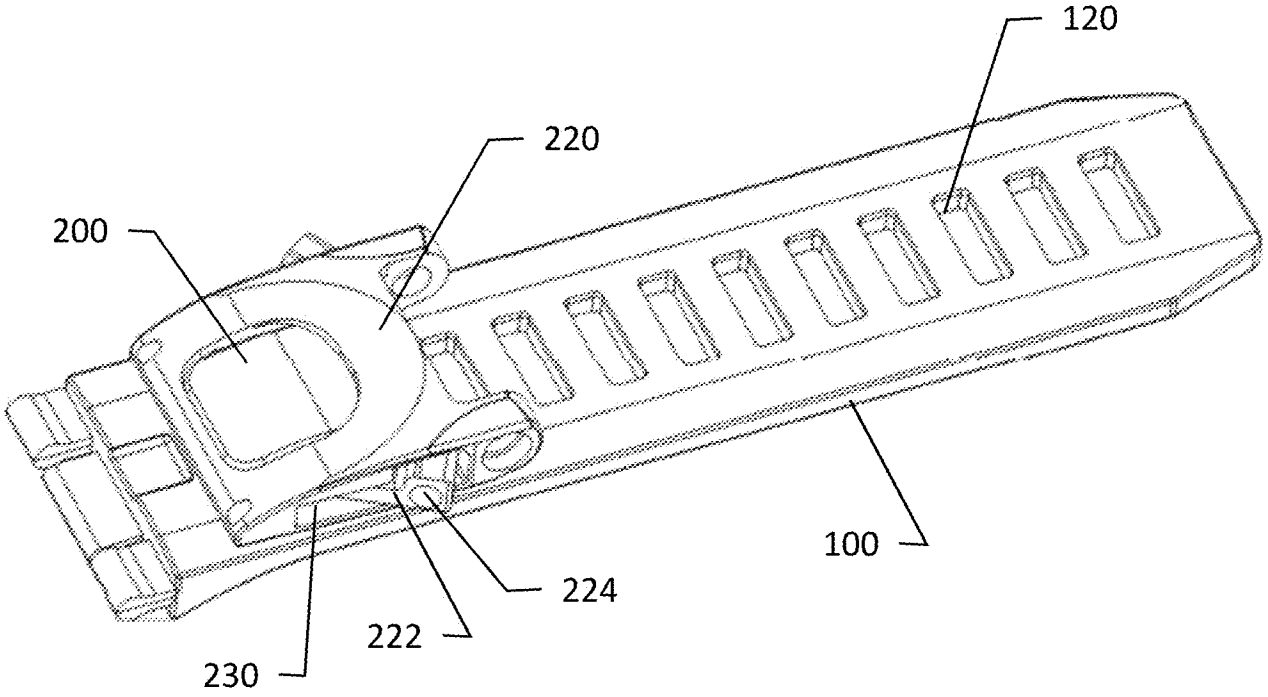
Figure 12:
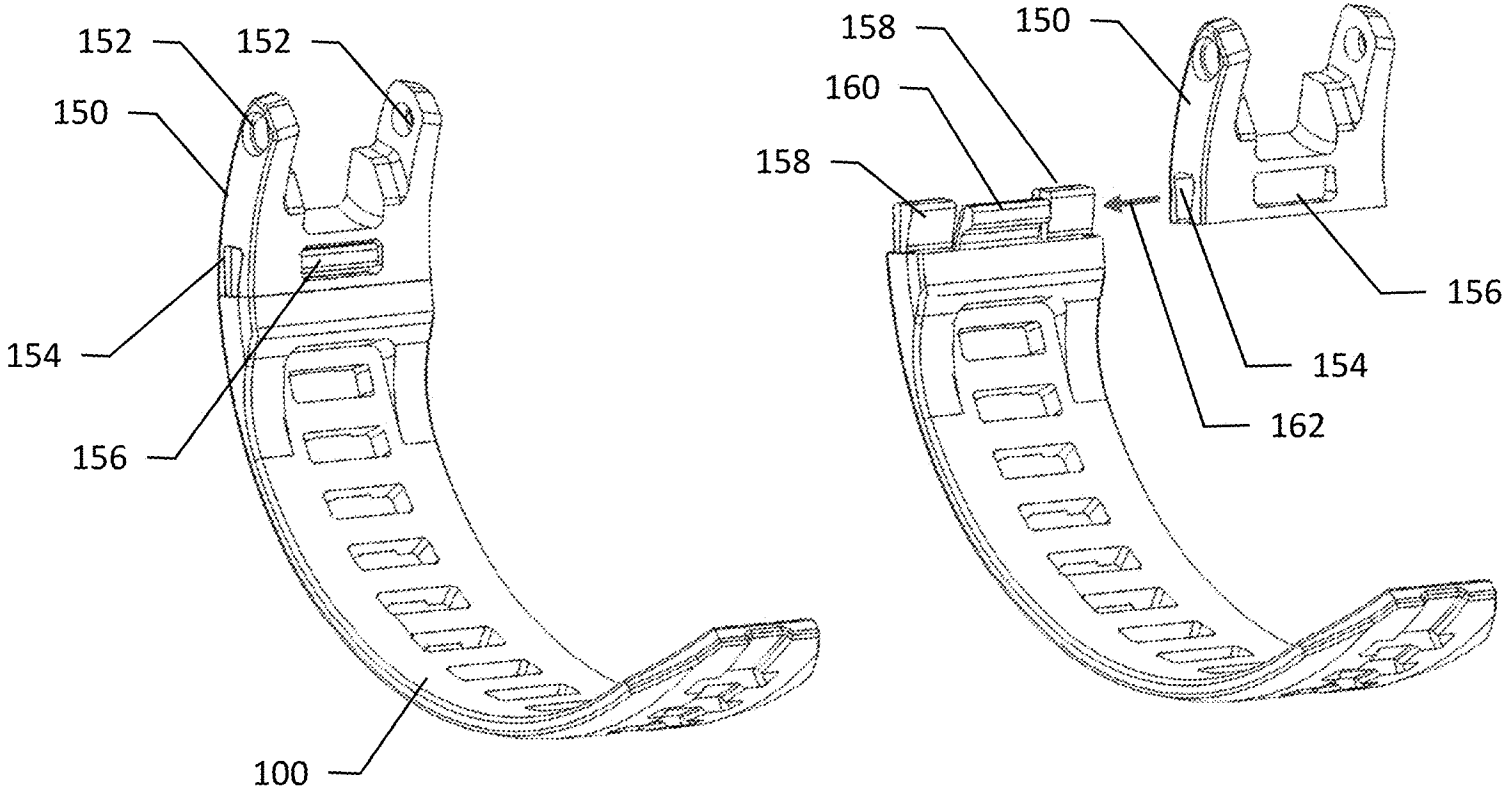
Figure 13:
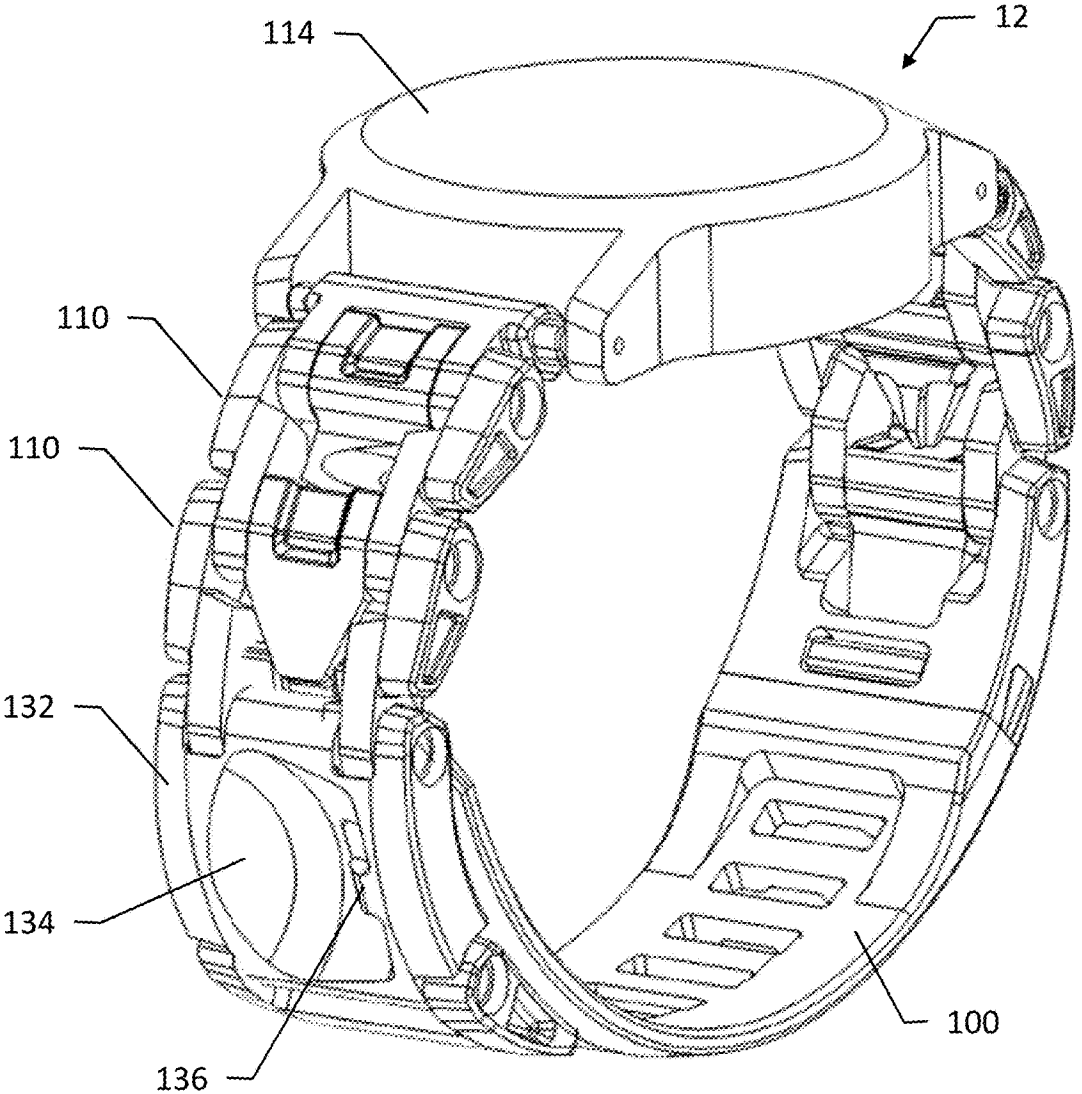
Figure 14:
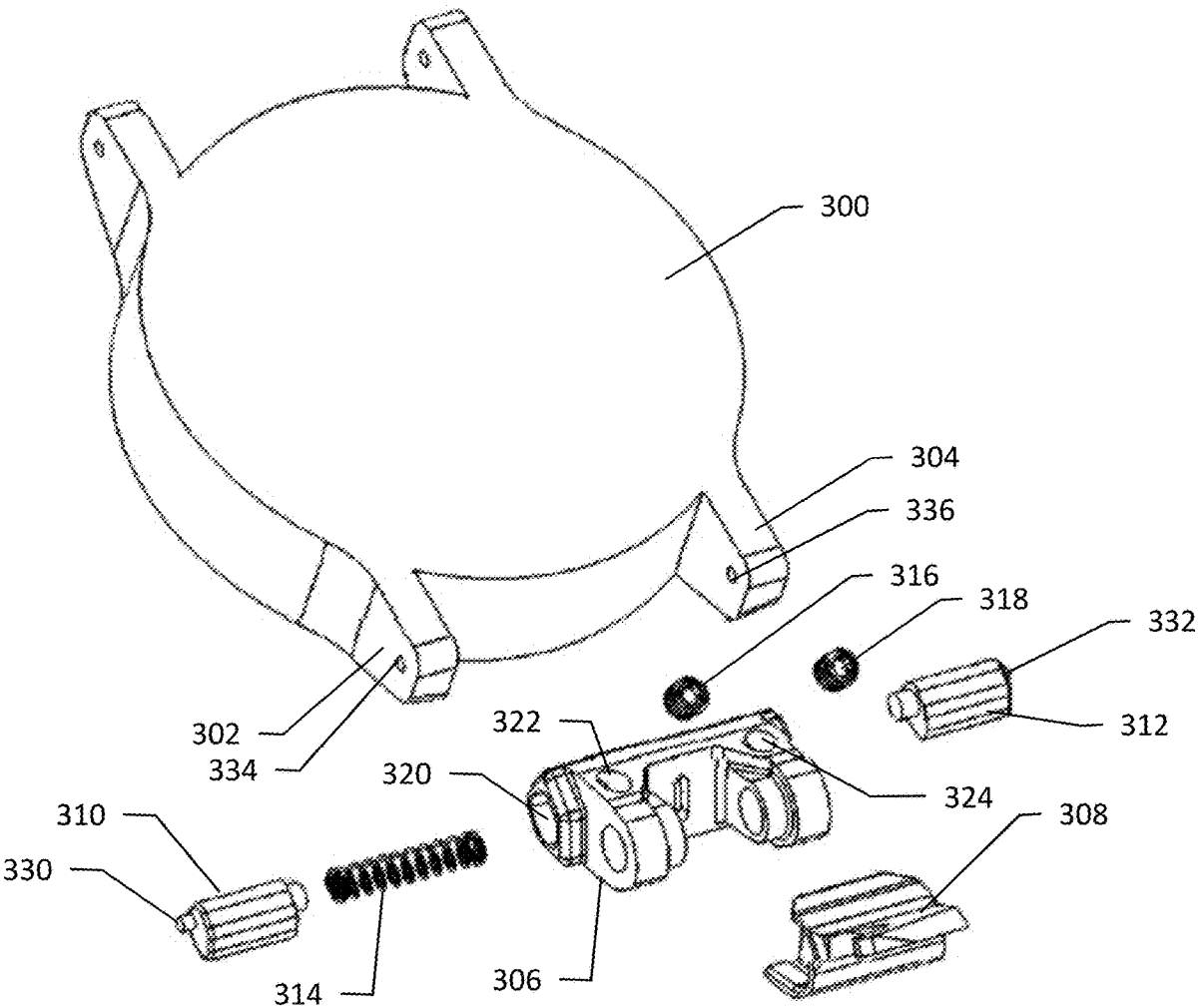

Having thus described example embodiments of the invention in general terms, reference will now be made to the accompanying drawings, which are not necessarily drawn to scale, and wherein:

FIG. 1 is a perspective view of a tool in accordance with an example embodiment of the present disclosure that includes a plurality of links that form a wearable accessory, such as a bracelet or a watch;

FIG. 2 is an exploded view of a link unit and portions of an adjacent link unit according to an example embodiment of the present disclosure;

FIG. 3 is a perspective view of the tool of FIG. 1 in a second configuration according to an example embodiment of the present disclosure;

FIG. 4 illustrates two views of a link unit according to an example embodiment of the present disclosure;

FIG. 5 depicts four link members including four different tool functions according to an example embodiment of the present disclosure;

FIG. 6 is a profile view of the tool of FIG. 1 with the clasp in an open position according to an example embodiment of the present disclosure;

FIG. 7 is a profile view of the tool of FIG. 1 with the clasp in a partially closed position according to an example embodiment of the present disclosure;

FIG. 8 is a profile view of the tool of FIG. 1 with the clasp in a closed position according to an example embodiment of the present disclosure;

FIG. 9 is a perspective view of the tool of FIG. 1 with the clasp in a closed position according to an example embodiment of the present disclosure;

FIG. 10 is a perspective view of a magnetic clasp in an open position according to an example embodiment of the present disclosure;

FIG. 11 is a perspective view of the magnetic clasp of FIG. 10 in a closed position according to an example embodiment of the present disclosure;

FIG. 12 illustrates a removable link element for attaching a band to the tool according to an example embodiment of the present disclosure;

FIG. 13 depicts another perspective view of a tool in accordance with an example embodiment of the present disclosure that includes a plurality of links that form a wearable accessory, such as a bracelet or a watch; and FIG. 14 illustrates a watch element and an adjustable watch lug link according to an example embodiment of the present disclosure.

DETAILED DESCRIPTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Referring now to FIG. 1, a tool in accordance with an example embodiment of the present invention is depicted. The tool includes a plurality of link units such as three or more link units, movably interconnected to one another so as to form at least a portion of a wearable accessory. The link units may include a link 10 and a pair of linkage members 16. The plurality of link units may form at least a portion of a wide variety of wearable accessories including a watch 12 as shown in FIG. 1. In the illustrated embodiment, the plurality of link units form only a portion of the wearable accessory. However, in other embodiments, the plurality of link units may form the entirety of the wearable accessory. Further, example embodiments may not include a watch element 14 which may allow more link units 10 to be accommodated about the wearable accessory.

The plurality of link units including links 10 and linkage members 16 may be interconnected directly one to another or indirectly with other intervening members, such as decorations, non-tool links or the like, positioned therebetween. Regardless of the manner of connection, the interconnection of the link units allows for limited relative movement between the link units while still securing the link units to one another. In the illustrated embodiment, the adjacent links 10 are interconnected by a linkage members 16 that extend between and are rotatably connected to adjacent pairs of links 10.

FIG. 2 illustrates an exploded view of a pair of adjacent links 20 and 22. As shown, the links are mechanically secured to linkage members 16. The linkage members 16 each include a key 26 which is received into a keyway 28 of a respective link. This key 26 provides a secure, non-pivoting connection between a pair of linkage members 16 and a link 20. However, the linkage members 16 that connect outside of adjacent linkage members relative to the key 26, such as where portion 30 of a linkage member 16 connects to link 20, have a connection that is pivotable. In this manner, each pair of linkage members 16 is secured in a non-pivotable manner to a single link 20 to form a link unit, while the connection between the same pair of linkage members 16 with a subsequent link 22 and linkage members 16 may be pivotable. While the illustrated embodiment depicts the link 20 having keyways 28 and the linkage members 16 having keys 26, embodiments may optionally include links with keys and linkage members defining keyways while having the same desired effect. Having each link 20 secured in a non-pivoting manner to a single pair of linkage members 16 in a link unit provides stability for using a tool of the link 20 as described further below. The pin 32 used to secure link units together, where each link unit comprises a pair of linkage members 16 with a link 20 disposed there between, provides a pivotable connection between each link unit. As shown in the example embodiment of FIG. 2, the pin 32 may be inserted through to linkage member 16 of two adjacent link units and secured on an opposite side of the link unit with a fastener 34. This fastener 34 and pin 32 combination provides a pivotable connection between adjacent link units.

The linkage members 16 and the links 10 are designed such that the adjacent link units are permitted to articulate, e.g., move, rotate or the like, relative to one another, while remaining mechanically connected. Thus, the fastener that secures the linkage member to a link in the illustrated embodiment may do so in a manner that maintains the mechanical connection while still permitting at least some relative movement between the adjacent link units. Link units may be interconnected in other manners that maintain the mechanical connection between adjacent links while permitting articulation therebetween, such as through the use of shoulder screws.

The plurality of link units are articulatable such that the plurality of links may assume different configurations. For example, the plurality of link units may assume a first configuration in which the bracelet is folded substantially flat with two layers of links lying one atop the other. The plurality of link units may also assume a second configuration in which the plurality of links are curved about an axis in a first direction. An example of the second configuration may be that shown in FIG. 1. Another configuration is depicted in FIG. 3, in which the watch 12 is unclasped and a plurality of link units 40 and part of the clasp 42 are folded relative to the watch element 14 in order to expose a tool 44 of link 46. The tool 44 of the illustrated embodiment is a C-shaped "hook" blade which may be useful for opening packages or cutting threads, for example. The method of articulation afforded by the pivoting configuration of link units described above provides a structure which permits the use of tools disposed on the links. The link units, in a folded configuration as shown with the links 40 of FIG. 3 provide a substantially rigid handle by which a user may grasp the watch (or other wearable accessory configuration) and use the tool exposed by the folding of the link units. The folded configuration provides a unit which is substantially rigid in torsion such that a tool, such as a screwdriver, can be used with force applied by a user through the folded watch or wearable accessory.

The axis about which the links 10 and link units are curved may be defined by the axis that extends through the center of the wearable accessory, such as a watch 12, or any other axis that extends parallel thereto. For example, the axis about which a pair of adjacent link units articulate, such as the axis defined by any one of the pins 32 or fasteners 34 that attach a linkage member 16 to a respective link 10, may also define the axis about which the links are curved.

The plurality of link units are configured to permit limited motion in a direction parallel to the axis prior to becoming structurally rigid. In this regard, the links 10 and their respective linkage members 16 are attached to one another and are otherwise configured so as to permit limited motion in the direction of the axis, such as in the direction of an axis that extends through the center of the wearable accessory, such as a bracelet or watch 12. However, following the limited range of motion in the direction of the axis, the plurality of links then become structurally rigid and do not permit further motion in the same direction, which allows mechanical leverage to be applied to the tools of the links.

The link units may have a curved shape and are interconnected such that a concave surface of the links faces an interior of the watch 12 to encircle the wrist of a wearer. FIG. 4 illustrates an example embodiment of a link unit 50 including a link 10 and linkage members 16. In this regard, the interior surfaces of the link units of the embodiment of FIG. 1 face the interior of the watch and have a concave shape. As such, the links having the concave interior surface may rest more comfortably upon the wrist of the wearer.

At least one link 10 and, more typically, a plurality of links, such as every link, may include at least one tool function, such as the flat-blade screwdriver tool 52 of link unit 50. As shown in FIG. 3, the plurality of links of the watch 12 of FIG. 1 are opened, such as by being unclasped or by the disconnection of the linkage members from a respective link. In an embodiment that includes a clasp, the clasp may take various forms including a clasp 42 that may be separable as shown in FIG. 3 or a clasp that is openable but remains in line and connected to the plurality of links as described below. The plurality of links may include a variety of different tool functions in order to increase the utility of the tool.

By way of example, the plurality of links 10 may include various screwdriver blades such as the flat blade screwdriver of link 22 of FIG. 2 and the Phillips screwdriver head of link 20. The screwdriver blades may be of various sizes such as the standard sizes available. Tools may include Allen-key or hex-keys, Torx® or star drivers, cutting blades, pins, tweezers, or various other tools. Further, one or more of the links of the illustrated embodiment may include a single sheet cutter, a pick, an awl, a cap lifter, a cutting hook, and/or a carbide scribe/glass breaker. Although not shown, the links may include a wide variety of other tool functions, such as pozi drives or other tool functions. FIG. 5 illustrates several example embodiments of links including tools, such as the cutting hook 60 of link 62, the Phillips head screwdriver 64 of link 66, a flathead screwdriver 68 of link 70, and a narrow flathead screwdriver 72 of link 74.

As shown in FIG. 2, each of these tool functions may extend outwardly from the body of a link so as to project, for example, toward an adjacent link. However, the adjacent links are positioned relative to one another, such as by being spaced from one another by the linkage members 16, so as to provide sufficient clearance therebetween such that the adjacent links may rotatably move relative to one another without contact between the tool functions that extend outwardly therefrom.

In one embodiment in which the link units 50 have a curved shape and in which one or more of the links includes a screwdriver blade 20 as a tool function, the screwdriver blade may have a respective tip that extends substantially tangentially from an exterior surface of a respective link, thereby following the curved shape of the respective link that carries the screwdriver blade. Indeed, as shown in FIG. 4, the screwdriver blade 52 extends substantially tangentially to the curvature formed by the link 10 and the linkage members 16 of the link unit. As such, the screwdriver blade of this example embodiment will follow the same shape and contour as the links and will therefore be less likely to cause discomfort for the wearer. Similarly, other tool functions that extend outwardly from a respective link, such as a Robertson bit, a hex key, or the like, may also be positioned so as to extend substantially tangentially to the curved shape of the respective link.

Although a wide variety of tool functions are depicted in the embodiments of FIGS. 1 and 3 and are described above, the links 10 may include differently sized tool functions and/or different types of tool functions than those that are illustrated. As other examples of the varied types of tool functions that may be included, a link may include a tool function in the form of a memory card, a light emitting diode (LED) light, a fire starting media, a subscriber identity module (SIM) of a mobile phone, a pedometer, a clock or a storage compartment, such as an openable, lidded storage compartment for medicine, batteries or the like. For example, two or more links may include clocks that are set to the current time in different time zones of interest to the wearer.

In addition, as the links 10 and link units are configured to be separable, such as by removal of the pin 32 and fastener 34 that connects a link to adjacent links via respective linkage members 16, the tool may be customizably designed or tailored in the form of a wearable accessory, such as a bracelet by removing the watch element 14 and adding additional link units having tool functions, so as to have the particular combination of tool functions that are desirable for a particular wearer by selecting to include certain links that have tool functions that are desired by the user, but omitting other links that have tool functions that are not as frequently utilized or are otherwise not desired by the wearer. Once the desired collection of links has been identified and ordered in the manner desired by the wearer, the links may be connected to form at least a portion of the wearable accessory, such as a bracelet or watch, by the attachment of adjacent links, such as via respective linkage members. In this way the size of the wearable accessory, such as the bracelet, may also be customized for the wearer by including the number of links that permit the resulting bracelet or watch to fit properly when worn. Depending upon the size of the links, the length of the bracelet may be adjusted in quarter inch or half inch increments, for example. Additionally, the links that are chosen for inclusion within the wearable accessory, such as a bracelet, may be placed in any desired sequence since the links of an example embodiment have a common interface. In an example embodiment, the links may be connected and disconnected utilizing common household tools, such as a screwdriver, such that the multi-link tool of an example embodiment is readily customizable.

The wearable accessory of example embodiments described herein may include various clasp mechanisms to enable the accessory to be securely attached to a wearer's wrist. Embodiments may include a clasp styles similar to watches, including deployment clasps, butterfly clasps, deployment buckles, or a jewelry clasp, for example. One example embodiment of a novel clasp is illustrated in FIGS. 6-9, which uses a strap and clasp mechanism.

FIG. 6 depicts the wearable accessory in the form of a watch 12 including a plurality of link units 110 and a band 100. The band may be of a variety of materials, such as plastics, rubbers, composite materials, or the like. However, the band 100 is configured to be flexible to some degree to be able to curve about the wrist of a wearer. The clasp of the depicted embodiment includes a first clasp element 102 and a second clasp element 106. The first clasp element 102 is pivotable relative to an adjacent link unit about an axis defined by a pin 112. The second clasp element 106 is pivotable relative to the first clasp element about a pin 114 connecting the two clasp elements. The first clasp element 102 includes a first tab 104 while the second clasp element 106 includes a second tab 108. The first clasp element 102 and the second clasp element 106 are pivotable relative to the watch 12 in order to engage the band 100.

FIG. 7 illustrates the clasp of FIG. 6 partially closed relative to the band 100. As shown, the first clasp element 102 has been pivoted about axis 112 to a position in which the first tab 104 engages a hole 120 or slot within the band 100, more clearly illustrated in FIG. 9. FIG. 8 illustrates the clasp of FIG. 6 fully closed relative to the band 100. As shown, the first clasp element 102 is engaged via first tab 104 within a hole 120 of the band, while the second clasp element 106 has been pivoted about axis 114 and the second tab 108 is engaged with another hole 120 of the band 100. The two-point engagement between the clasp elements and the band 100 provide a more secure closure of the clasp while not allowing the clasp to rotate about an axis orthogonal to the axis of a wrist of a wearer. FIG. 9 illustrates the clasp in the closed position with the first tab 104 and the second tab 108 engaged with respective holes 120 of the band 100. The clasp of the embodiments of FIGS. 6-9 is pivotable to make the clasp easier to close and secure while being worn by a wearer. The first tab 104 provides initial engagement of the clasp with the band, while the second tab 108 provides complete security of the clasp with the band. This clasp design further facilitates the conformity of the clasp with the wrist of the wearer.

Another example embodiment of a clasp which may be used for example embodiments described herein may use magnetic force to close the clasp and mechanical features to lock the clasp in position until such time as a user wishes to open the clasp. FIG. 10 illustrates an example embodiment of the magnetic clasp which includes two primary components. The first component is a base 200 that attaches to a strap 100. The base may be secured to the strap such as through one or more fasteners that are received through holes 120 of the strap and into the lug. The base 200 may be repositionable along the strap 100 to adjust the size of the wrist worn accessory. The second primary component is the clasp 220 which attaches to the end of a link of the wrist worn accessory, in the position of where clasp element 102 is in FIGS. 6-9. The position of the clasp 220 is thus fixed relative to the accessory, while the base 200 is movable along the strap 100 to provide the adjustability and sizing necessary. As wrist worn accessories such as watches and bracelets are typically worn by a single user, the sizing of the accessory through movement of the base 200 is not frequently changed.

The base 200 includes two recesses 202 on opposite sides of the base, and may include two magnetic elements 204 on opposing sides of the base. The clasp 220 includes toggle elements 222, which each pivot about an axis 226, shown by arrow 228, orthogonal to the opening 230 into which the toggle elements are received. The toggle elements may each include a magnetic element 224. The toggle elements may be held in the position illustrated in FIG. 10 by another pair of magnetic elements not visible in the view shown, but positioned to align the toggle elements within their respective openings 230. Maintaining the toggle elements in the position shown in FIG. 10 enables the clasp 220 to receive therein the base 200 as shown in FIG. 11.

In response to the clasp 220 receiving therein the base 200 as depicted in FIG. 11, the toggle elements 222 toggle about the axis 226 to the position shown in FIG. 11, where each toggle element 222 engages a respective recess 202 of the base. The magnetic element 204 of the base may be of the same polarity as the magnetic element 224 of the clasp 220 such that they push away from one another, driving the toggle element into the recess 202 of the base 200. The magnetic forces of the magnetic element 224 of the clasp and the magnetic element 204 of the base may be configured to be stronger than a magnetic force used to align the toggle elements within their respective openings 230 as shown in FIG. 10, such that upon engagement of the clasp 220 with the base 200, the toggle elements engage the recesses 202 of the base. The recesses 202 of the base may further include magnetic elements to attract the toggle elements into the recesses, where the toggle elements 222 may include a magnetically attractive element to be received within the recesses 202. The magnetically attractive element of the toggle element 222 may be the same magnetic element that is used to align the toggle element within the opening 230 when the clasp 220 is not engaged with the base 200.

Through the actions described above, in response to the clasp 220 engaging the base 200, the clasp becomes securely locked to the base. The toggle elements 222 received within their respective recesses 202 preclude the clasp 220 from being pulled up and away from the base 200 along a first axis (e.g., a z-axis), while the pocket within the clasp that receives the base 200 precludes movement in a plane orthogonal to the first axis (e.g., the x-y plane). In order to uncouple the clasp 220 from the base 200, a user may press both toggle elements 222 that are exposed relative to the clasp 220 shown in FIG. 11 where the magnetic element 224 is positioned. This pressing motion acts against the magnetic forces biasing the toggle elements 222 into their respective recesses 202, and allows the clasp to be lifted from the base along the first axis. This clasp mechanism provides a secure clasp closure while enabling easy and fast removal by a user. Further, the clasp mechanism described above is unlikely to be accidentally opened, providing peace of mind to a wearer of the accessory.

The strap 100 of example embodiments described herein may be made of a variety of materials and may be configured to be interchangeable and/or replaceable. Materials for the link units may generally be of a durable material such as metal, which may be of a metallic color or anodized finish. However, a user may want to vary the color and/or material of their strap for customization or for different occasions. Embodiments described herein provide a quick and easy way to remove and install a strap without requiring tools. FIG. 12 illustrates the interchangeable nature of the strap 100 which is shown in a first position attached to a strap link 150, which may in turn be connected to a link of the wrist worn accessory of example embodiments via a pivotable connection such as a pin 32 and fastener 34 described above through holes 152. The strap link 150 may include a laterally extending keyway channel 154 through the strap link and an aperture 156. The strap may have one or more keys 158 that are received within the keyway channel 154, and a tab 160 which is received within the aperture 156. The keyway may be shaped such that it precludes the pulling of the strap 100 from the strap link 150 in the direction of the strap. The tab 160 may be biased relative to the keys 158 such that it is biased into engagement with the aperture 156. Removal of the strap may require depressing the tab 160 through aperture 156 such that the tab aligns with the keyway 154, and the strap 100 can slide along arrow 162 out from engagement with the strap link 150. Installation of the same or a new strap may be as easy, with alignment of a key 158 with the keyway 154 of the strap link 150, and insertion of the key into the keyway while pressing tab 160 to align with the keyway. Once the strap 100 is centered within the strap link 150, the tab 160 will be biased into engagement with the aperture 156 and the strap 100 and strap link 150 are securely connected.

As described above, link units 110 may be attached to one another to form, in whole or in part, a wrist worn accessory. The link units 110 may include a variety of tools as detailed previously. Beyond the link units described above, additional links may be used in various embodiments to provide additional functionality. One such element identified above is the watch element 14 that is connected between link units 110 to form the watch, as shown in FIG. 13. Another type of link may include, for example, a bottle opener link 132. The bottle opener link 132 may include a recess 134 into which a bottle cap may be received, and a tab 136 used to pry the bottle cap from the bottle. The lateral rigidity of the wrist worn accessory provided by the link units and pin/fastener configuration described above may permit use of the bottle opener link 132 while the accessory is being worn. Using a bottle opener on a wrist worn accessory lacking the lateral/torsional rigidity may result in discomfort as the accessory flexes and pinches the wrist of a user. However, given the rigidity of the present accessory, the bottle opener can be used while the accessory is worn without pinching or causing discomfort to the user.

The tool may include a variety of configurations. As shown throughout example embodiments illustrated herein, for example, the wearable accessory formed by the plurality of links 10 may also include a watch element 14 carried by the accessory 12. The plurality of links that form the strap for the watch in this example embodiment also include a plurality of tool functions. The watch element 14 attached to some example embodiments may be any of a variety of watch elements, such that the size of the watch element may differ. Example embodiments provided herein employ a link configured to connect to a plurality of sizes of watch elements to improve the universality of the accessory. Standard watch elements may have a "lug width" and may be configured to receive watch bands of a specific width between lugs 302 and 304 of watch element 300 shown in FIG. 14. Standard lug widths may range from 8-millimeters to 32-millimeters, while more common lug widths may be in the range of 16-millimeters to 24-millimeters. Embodiments of the present disclosure may provide a mechanism to secure watch elements to a watch link where the lug widths may vary over a predefined range. The watch link described herein provides flexibility in receiving a watch element 300 of various sizes without requiring a unique watch link for each. Further, embodiments provide a structurally robust mechanism for receiving watch elements of varying lug widths that maintains the structural rigidity of the wrist worn accessory described herein relative to the interconnection between link units.

FIG. 14 illustrates an exploded view of a watch link 306 of example embodiments which may be configured, as described above with respect to the link units, to engage a tool 308 providing additional functionality of the watch link 306. The watch link 306 may include a passageway 320 through the watch link which may receive therein a first adjustable pin 310 and a second adjustable pin 312, with a spring 314 disposed therebetween. The adjustable pins 310, 312, and the passageway 320 may be of a shape that precludes rotation of the pins within the passageway. Such a shape may be any polygon, regular or irregular, or may include a substantially circular shape with a flat facet, for example. The adjustable pins 310, 312, may have a length to provide enough travel into and out of the passageway 320 to accommodate various lug widths. For example, the watch link 306 at the passageway 320 may have a width of 18-millimeters, and the adjustable pins 310, 312, may be sized to be received fully into the passageway including the lug engaging pins 330, 332. This would accommodate a lug width of 18-millimeters. Pressing the adjustable pins 310, 312 into the passageway against the bias of the spring allows the watch link 306 to be received between the lugs 302, 304. The spring 314 then biases the adjustable pins outwardly such that the lug-engaging pins 330, 332, can engage the holes 334, 336 of the lugs.

Once the lug-engaging pins 330, 332 are engaged with respective holes of the lugs, the adjustable pins 310, 312 may be secured in position to prevent the adjustable pins from being pressed against the bias of the spring 314 potentially disengaging the lug-engaging pins 330, 332, from the holes 334, 336 of the lugs. To secure the adjustable pins in place, set screws 316, 318 may engage set screw holes 322 and 324, respectively. Upon tightening, the set screws 316, 318 may be adjusted to engage the adjustable pins 310, 312, and lock the adjustable pins in place, thereby securing the watch link 306 to the watch element 300 in pivotable engagement. While the width of the watch link 306 may define the narrowest lug width that the watch link may engage, the length of the adjustable pins 310, 312, may define the widest lug width which may be engaged. The widest lug width may be limited by the degree to which the adjustable pins may extend from the watch link 306 while still being secured by the set screws 316, 318. The adjustable pins 310, 312, may be configured to extend a predefined distance from the passageway 320, such as 3-millimeters, from the passageway while still being able to be engaged by the set screws. This would provide an adjustable width of 6-millimeters, giving the watch link a range of lug widths that varies up to 6-millimeters, for example, 18-millimeters to 24-millimeters. This degree of adjustability may be greater or less depending upon the configuration of the watch link 306 and the adjustable pins 310, 312.

As described above, a tool is provided that includes a plurality of links 10 that are interconnected to one another to form at least a portion of a wearable accessory, such as a bracelet or watch 12. At least one of the links may include at least two tool functions and, in one embodiment, links may include one or more tool functions such that the tool has many types of tool functions and many differently sized tool functions, thereby increasing the utility of the tool. Moreover, by being configured as a wearable accessory and by the selection of the tool functions to provide the desired functionality without including a prohibited item, such as a knife, the multi-link tool may be carried in a wider range of situations, including on board an aircraft or in other secure environments. Thus, the tool of an example embodiment may facilitate the availability of the tool functions provided by the links of the wearable accessory.

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. A wearable accessory comprising:

a first link unit comprising a first link disposed between and engaged with first and second linkage members, wherein the link is held in a fixed, non-rotatable position relative to the first and second linkage members;

the first link of the first link unit comprises a tool comprising at least one of a screwdriver, a bottle opener, a hex-key, an Allen-key, a star driver or a cutting blade;

a second link unit comprising a second link disposed between and engaged with third and fourth linkage members, wherein the second link is held in a fixed, non-rotatable position and relative to the third and fourth linkage members; and a pin connecting the first link unit and the second link unit, wherein the pin is engaged through third and fourth holes defined through the third and fourth linkage members respectively of the second link unit, first and second holes defined through the first and second linkage members respectively of the first link unit, and a link hole through the first link.

2. The wearable accessory of claim 1, wherein the first and second linkage members of the first link unit comprise respective first and second keys and the first link of the first link unit comprises first and second keyways to receive the first and second keys of the first and second linkage members of the first link unit, wherein the first and second keys received into the respective first and second keyways hold the first and second linkage members and the first link of the first link unit in a fixed and non-rotatable relationship.

3. The wearable accessory of claim 1, wherein the first and second link units are among a plurality of interconnected link units that are each shaped so as to alternately assume:

a first configuration in which the plurality of interconnected link units are curved about an axis in order to define an opening through the wearable accessory, wherein the wearable accessory is configured to be worn by a user in the first configuration, and a second configuration in which the plurality of interconnected link units are repositioned to fold to position at least a portion of the plurality of interconnected link units against at least another portion of the wearable accessory to serve as a handle to facilitate actuation of a respective tool in the second configuration.

4. The wearable accessory of claim 3, wherein the respective tool is positioned so as to be substantially on a centerline defined by the plurality of interconnected link units in the first configuration, and wherein the respective tool extends outwardly from the plurality of interconnected link units in the second configuration.

5. The wearable accessory of claim 3, wherein the plurality of interconnected link units are repositioned in the second configuration so as to extend linearly to serve as the handle with the respective tool at one end thereof.

6. The wearable accessory of claim 1, wherein the first link unit and the second link unit comprise a substantially arcuate profile.

7. The wearable accessory of claim 6, wherein the first link unit and the second link unit join together such that a concavity of the substantially arcuate profile faces an interior of the wearable accessory.

8. The wearable accessory of claim 1, further comprising a watch link, wherein the watch link comprises two adjustable pins disposed within the watch link and biased away from one another for engaging respective lugs of a watch.

9. The wearable accessory of claim 8, wherein the watch link further comprises two set screws, each set screw configured to engage a respective adjustable pin and hold the respective adjustable pin in a fixed position.

10. The wearable accessory of claim 1, further comprising a clasp and a band, wherein the band is connected to the second link unit, wherein the clasp comprises a first clasp member having a first tab and a second clasp member having a second tab, wherein the first clasp member is pivotably attached to a third link unit, and wherein the second clasp member is pivotably attached to the second clasp member.

11. The wearable accessory of claim 10, wherein the band comprises a plurality of holes, and wherein the first tab is configured to engage a first hole of the band, and the second tab is configured to engage a second hole of the band to close the clasp.

12. The wearable accessory of claim 1, further comprising a clasp and a band, wherein the band is connected to the second link unit, wherein the clasp comprises a first clasp member pivotably attached to a second link unit and a second clasp member removably attached to the strap, and wherein the first clasp member magnetically engages the second clasp member to close the clasp.

13. The wearable accessory of claim 12, wherein the first clasp member further comprises at least one toggle element, wherein the at least one toggle element is biased in a first position relative to the first clasp member when the first clasp member is not engaged with the second clasp member, and wherein the at least one toggle element is magnetically biased into a second position relative to the first clasp member, into engagement with the second clasp member when the first clasp member is engaged with the second clasp member.

14. A link unit for a wrist-worn tool comprising:

a link member comprising a tool member and defining first and second opposing keyways;

a first linkage member comprising a first key; and a second linkage member comprising a second key;

wherein the first key of the first linkage member is configured to engage the first keyway of the link member, wherein the second key of the second linkage member is configured to engage the second keyway of the link member, wherein the link member is held in a fixed position relative to the first linkage member and the second linkage member due to the first key engaging with the first keyway and the second key engaging with the second keyway, and wherein a hole is defined through the first linkage member through the first key, through the second linkage member and the second key, and through the link member, wherein the hole is configured to receive there through a pin for securing the link unit to another link unit.

15. The link unit of claim 14, wherein the first linkage member and the second linkage member extend in a first direction from the link member when the first key is engaged with the first keyway and the second key is engaged with the second keyway, and wherein the tool member extends in a direction substantially opposite to the first direction.

16. The link unit of claim 14, wherein when the first key is engaged with the first keyway and the second key is engaged with the second keyway, the link unit defines a substantially arcuate profile.

17. The link unit of claim 16, wherein a concave side of the link unit is configured to at least partially encircle a wrist of a wearer of the wrist-worn tool.

18. A link unit for a wrist-worn tool comprising:

a link member comprising a tool member and comprising first and second opposing keys;

a first linkage member defining a first keyway; and a second linkage member defining a second keyway;

wherein the first key of the link member is configured to engage the first keyway of the first linkage member, wherein the second key of the link member is configured to engage the second keyway of the second linkage member, and wherein the link member is held in a fixed and non-rotatable position relative to the first linkage member and the second linkage member by the first key engaging the first keyway and the second key engaging the second keyway, wherein a hole is defined through the first linkage member through the first key, through the second linkage member and the second key, and through the link member, wherein the hole is configured to receive there through a pin for securing the link unit to another link unit.

* * * * *